US010132173B2

(12) United States Patent
Dungs et al.

(10) Patent No.: US 10,132,173 B2
(45) Date of Patent: Nov. 20, 2018

(54) ARRANGEMENT FOR SECURING A FUNCTIONAL POSITION OF A SHROUD PLATE ARRANGED ON A ROTOR DISC RELATIVE TO A MOVING BLADE ARRANGED ON THE ROTOR DISC

(71) Applicant: Siemens Aktiengesellschaft, Munich (DE)

(72) Inventors: Sascha Dungs, Wesel (DE); Karsten Kolk, Mulheim a.d. Ruhr (DE); Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 340 days.

(21) Appl. No.: 15/025,589

(22) PCT Filed: Sep. 4, 2014

(86) PCT No.: PCT/EP2014/068825
§ 371 (c)(1),
(2) Date: Mar. 29, 2016

(87) PCT Pub. No.: WO2015/051956
PCT Pub. Date: Apr. 16, 2015

(65) Prior Publication Data

US 2016/0222799 A1 Aug. 4, 2016

(30) Foreign Application Priority Data

Oct. 10, 2013 (EP) ..... 13187993

(51) Int. Cl.
*F01D 5/30* (2006.01)
*F01D 5/08* (2006.01)
*F01D 11/00* (2006.01)

(52) U.S. Cl.
CPC ..... *F01D 5/3015* (2013.01); *F01D 5/081* (2013.01); *F01D 11/006* (2013.01);
(Continued)

(58) Field of Classification Search
CPC . F01D 5/081; F01D 5/082; F01D 5/30; F01D 11/005; F01D 11/006; F01D 5/326;
(Continued)

(56) References Cited

U.S. PATENT DOCUMENTS 3,010,696 A * 11/1961 Everett ..... F01D 5/081 416/97 R
3,070,351 A * 12/1962 Hunt, Jr. ..... F01D 5/3015 416/221

(Continued)

FOREIGN PATENT DOCUMENTS

CN 1490496 A 4/2004
CN 101220756 A 7/2008

(Continued)

OTHER PUBLICATIONS

CN Office Action dated Sep. 2, 2016, for CN application No. 201480055798.8.

*Primary Examiner* — Jason Shanske
*Assistant Examiner* — Topaz L Elliott
(74) *Attorney, Agent, or Firm* — Beusse Wolter Sanks & Maire

(57) ABSTRACT

An arrangement for securing a functional position of a shroud plate of a rotor of a gas turbine, which shroud plate is arranged on an outer circumference of a rotor disc of the rotor, relative to a moving blade of the rotor arranged on the outer circumference of the rotor disc, wherein a channel portion of an annular cooling channel of the rotor is formed between the shroud plate located in its functional position and a side, facing the shroud plate, of a blade root of the (Continued)

moving blade. A rotor assembly for a rotor of a gas turbine, having a rotor disc, a moving blade ring arranged on the outer circumference of the rotor disc and a shroud plate ring arranged on the outer circumference of the rotor disc.

15 Claims, 4 Drawing Sheets

(52) U.S. Cl.
CPC ..... *F05D 2220/32* (2013.01); *F05D 2240/55* (2013.01); *F05D 2240/80* (2013.01); *F05D 2260/30* (2013.01); *F05D 2260/31* (2013.01)

(58) Field of Classification Search
CPC .. F01D 5/3007; F01D 5/3015; F05D 2260/30; F05D 2260/31; F05D 2240/55
See application file for complete search history.

(56) References Cited

U.S. PATENT DOCUMENTS

| | | | | |
|---|---|---|---|---|
| 6,000,909 | A | 12/1999 | Hirokawa et al. | |
| 8,226,366 | B2 * | 7/2012 | Brucher | F01D 5/3015 416/219 R |
| 8,888,460 | B2 * | 11/2014 | Ahaus | F01D 5/081 416/220 R |
| 2004/0042900 | A1 | 3/2004 | Dohertie et al. | |
| 2008/0181768 | A1 | 7/2008 | Brucher et al. | |
| 2011/0163506 | A1 | 7/2011 | Hafner | |
| 2012/0128504 | A1 | 5/2012 | Bruecher et al. | |

FOREIGN PATENT DOCUMENTS

| | | | |
|---|---|---|---|
| CN | 102116180 | A | 7/2011 |
| EP | 1944471 | A1 | 7/2008 |
| JP | 2003314205 | A | 11/2003 |
| WO | 2010094539 | A1 | 8/2010 |

* cited by examiner

ARRANGEMENT FOR SECURING A FUNCTIONAL POSITION OF A SHROUD PLATE ARRANGED ON A ROTOR DISC RELATIVE TO A MOVING BLADE ARRANGED ON THE ROTOR DISC

CROSS REFERENCE TO RELATED APPLICATIONS

This application is the US National Stage of International Application No. PCT/EP2014/068825 filed Sep. 4, 2014, and claims the benefit thereof. The International Application claims the benefit of European Application No. EP13187993 filed Oct. 10, 2013. All of the applications are incorporated by reference herein in their entirety.

FIELD OF INVENTION

The invention relates to an arrangement for securing a functional position of a shroud plate of a rotor of a gas turbine, which shroud plate is arranged on an outer circumference of a rotor disc of the rotor, relative to a moving blade of the rotor arranged on the outer circumference of the rotor disc, wherein a channel portion of an annular cooling channel of the rotor is formed between the shroud plate located in its functional position and a side, facing the shroud plate, of a blade root of the moving blade.

The invention further relates to a rotor assembly for a rotor of a gas turbine, comprising a rotor disc, a moving blade ring arranged on the outer circumference of the rotor disc and a shroud plate ring arranged on the outer circumference of the rotor disc.

The invention further relates to a rotor for a gas turbine and to a gas turbine.

BACKGROUND OF INVENTION

An arrangement of the above-stated type is known for example from publication WO 2010/094539 A1. To secure a functional position of a shroud plate of a rotor of a gas turbine, which shroud plate is arranged on an outer circumference of a rotor disc of the rotor, relative to a moving blade of the rotor arranged on the outer circumference of the rotor disc, said publication proposes inserting a locking element into an opening formed in the manner of keyhole in the shroud plate, which locking element engages in its functional position in a hole arranged on a side, facing the shroud plate, of a blade root of the moving blade. This functional position of the locking element is secured in that, in a given rotational position relative to the shroud plate, the locking element engages behind the edge of the opening on the blade root side by means of a cam formed on the locking element and in that the locking element located in this rotational position is secured against rotation relative to the shroud plate about a longitudinal axis of the locking element. Securing of the rotational position of the locking element is achieved in that part of the locking element is deformed plastically and thereby engages in a bit opening of the keyhole-like opening.

SUMMARY OF INVENTION

The object of the invention is to provide a novel and simple way of securing functional positions of shroud plates of a rotor of a gas turbine, which shroud plates are arranged on an outer circumference of a rotor disc of the rotor, relative to moving blades of the rotor arranged on the outer circumference of the rotor disc.

The arrangement according to the invention for securing a functional position of a shroud plate of a rotor of a gas turbine, which shroud plate is arranged on an outer circumference of a rotor disc of the rotor, relative to a moving blade of the rotor arranged on the outer circumference of the rotor disc, wherein a channel portion of an annular cooling channel of the rotor is formed between the shroud plate located in its functional position and a side, facing the shroud plate, of a blade root of the moving blade, comprises—a web which may be arranged on the side of the blade root facing the shroud plate, which web may be arranged in such a way on the blade root that the web extends radially relative to the rotor disc when the moving blade is arranged on the rotor disc,—a guide portion, which may be formed by a thickened portion formed on the shroud plate, and a guide opening, which may be formed by a through-hole arranged on the shroud plate, wherein the guide portion at least partially surrounds the guide opening,—a securing bolt comprising a longitudinal through-hole, the external diameter of which corresponds to the diameter of the guide opening and which comprises at one end two cut-aways arranged diametrically relative to one another, open towards said end and of equal width, which cut-aways extend from said end of the securing bolt parallel to the longitudinal axis of the securing bolt over part of the length of the securing bolt, wherein the width of the cut-aways is greater than or equal to the width of the web, and—a securing device for securing a functional position of the securing bolt on the shroud plate and the moving blade.

According to the invention, the functional position of the shroud plate is secured if the securing bolt extends partly in the guide opening which may be formed on the guide portion of the shroud plate and the web is arranged at least partly in the cut-aways. This is effected in particular in that the web extends radially relative to the rotor disc when the moving blade is arranged on the rotor disc.

The thickened portion formed on the shroud plate or the guide portion which may be formed thereby allows the formation of a longer guide opening and thereby good guidance for the securing bolt. In addition, during operation of a correspondingly configured gas turbine, forces arising through contact with the securing bolt in the region of the guide opening may be better absorbed by the shroud plate as a result of the thickened portion or the guide portion, without the occurrence of damage to the shroud plate, in particular in the region of the guide opening. The guide portion in particular completely surrounds the guide opening.

The fact that the external diameter of the securing bolt corresponds to the diameter of the guide opening means that the securing bolt may be inserted form-fittingly into the guide opening.

The diametric arrangement of the cut-aways and the configuration thereof open towards the end of the securing bolt allows simultaneous insertion of the web into the two cut-aways, by pushing the securing bolt onto the web. To achieve form-fitting joints between the cut-aways and the web, the width of the cut-aways is advantageously equal to the width of the web.

The securing device for securing a functional position of the securing bolt on the shroud plate and the moving blade holds the securing bolt permanently securely in its position pushed onto the web, i.e. in its functional position. The securing device may be configured in any manner suitable for this purpose.

The arrangement according to the invention may be achieved in the course of retrofitting an existing gas turbine. In addition, the arrangement may be taken into consideration in a new gas turbine development. The most varied types of gas turbine may be provided with the arrangement according to the invention. In an embodiment, an arrangement according to the invention is provided for each shroud plate of a rotor.

The securing bolt and/or the web are formed of metal and may be suitably hardened to reduce wear to said components.

In an embodiment, the securing device comprises a groove arranged on the side of the guide portion facing the blade root, which groove extends from the guide opening radially over at least part of the guide portion, and an L-shaped, plastically deformable securing wire, wherein the diameter of the longitudinal bore of the securing bolt, the width of the groove and the width of the cut-aways are greater than or equal to the external diameter of the securing wire. One leg of the L-shaped securing wire may be introduced in this way into the longitudinal hole in the securing bolt partly arranged in the guide opening on the shroud plate, until the other leg of the securing wire is located at least partly in the groove formed on the guide portion. If the leg of the securing wire arranged at least partly in the groove simultaneously extends through one of the cut-aways on the securing bolt, the securing bolt is secured relative to the shroud plate against rotation about its longitudinal axis. To achieve optimum robustness of the arrangement, the diameter of the longitudinal bore, the width of the groove and the width of the cut-aways are advantageously equal to the external diameter of the securing wire, such that corresponding form-fitting joints may be produced between components of the arrangement.

One cut-away is advantageously longer than the other cut-away by a specified difference in length, wherein the difference in length is greater than or equal to the external diameter of the securing wire. The difference in length is advantageously equal to the external diameter of the securing wire. The length of the shorter cut-away may for example correspond to the height of the web, whereas the length of the longer cut-away may correspond to the sum of the height of the web and the external diameter of the securing wire. To simplify the production effort associated with the securing bolt, the cut-aways may alternatively be of equal length.

The web is advantageously formed in one piece with the moving blade. The web may for example be produced inexpensively together with the remainder of the moving blade using a casting method. This gives a very robust joint between the web and the remainder of the moving blade. Alternatively, the web may be produced separately and then joined to the moving blade.

The web may advantageously be arranged in a recess which may be formed on a side of the blade root facing the shroud plate. This enables axial installation space to be saved, so as to allow compact configuration of a rotor and/or of a gas turbine despite the attachment of an arrangement according to the invention to the rotor of the gas turbine.

At least one longitudinal edge of the web arranged on the side of the web remote from the blade root is advantageously provided with a chamfer. The chamfer may be formed by post-machining of the web formed on the moving blade. Advantageously, both longitudinal edges of the web arranged on the side of the web remote from the blade root are each provided with a chamfer. Formation of the chamfer or chamfers on the web enables simpler assembly of the arrangement, which is made more difficult in particular because the web is barely or not visible during assembly of the arrangement. The chamfer or chamfers on the web may result, on contact between the securing bolt or the edges of the cut-aways formed on the securing bolt and the web, in a desired forced orientation of the securing bolt relative to the web, in order to be able to push the securing bolt as desired onto the web or to move the securing bolt into its functional position.

The end of the securing bolt not provided with the cut-aways is advantageously provided, on a side facing the longitudinal hole, with rounding extending over at least part of the inner circumference of the longitudinal bore. The rounding may serve as a contact surface for plastic shaping of the securing wire, in order to bend, advantageously by 90°, an end of the securing wire remote from the blade root and projecting out of the securing bolt. This plastic deformation of the securing wire may be used to retain the securing bolt permanently in its functional position. Without the rounding at the end of the securing bolt, damage to the securing wire could occur on bending of the securing wire and/or under mechanical stresses when a correspondingly configured gas turbine is in operation. This could in turn impair the permanence of the corresponding securing of the functional position of the securing bolt.

Advantageously, at least one free end of at least one cut-away is provided with a chamfer. The chamfer may be formed by post-machining of the free end of the cut-away. Both free ends of each cut-away are advantageously in each case provided with a chamfer. Formation of the chamfer or chamfers at the cut-away or the cut-aways likewise allows simpler assembly of the arrangement, which is made more difficult in particular because the web is barely or not visible during assembly of the arrangement. The chamfers at the free ends of the cut-aways may result, on contact between the securing bolt or the chamfers formed on the securing bolt and the web, on which chamfers may likewise be formed, in a desired forced orientation of the securing bolt relative to the web, in order to be able to push the securing bolt as desired onto the web or to move the securing bolt into its functional position.

The arrangement advantageously comprises a sealing groove which may be arranged on the blade side on a sealing wing formed on a platform of the moving blade, in which sealing groove a radially outer edge portion of the shroud plate may be arranged. In the case of an arrangement properly mounted on a rotor, the radially outer edge portion of the shroud plate is introduced into part of the sealing groove. When a gas turbine equipped in this way is in operation, the shroud plate may move radially outwards and extend further into the sealing groove. The further the radially outer edge portion of the shroud plate extends into the sealing groove, the better is the shroud plate sealed relative to the sealing wing, a fact which is associated with an improvement in the sealing of an annular cooling channel of the rotor formed between the shroud plates and the blade roots. When a gas turbine is in operation, tilting movements of the platforms of the moving blades and consequently of the sealing wings of the moving blades additionally generally arise. Because of the play present in the sealing groove and the punctiform suspension of the shroud plate on the rotor by way of the securing bolt, a shroud plate may rotate about the securing bolt by a given amount, in order to be able to follow the tilting movements of the platforms by a given amount.

The rotor assembly according to the invention for a rotor of a gas turbine comprises a rotor disc, a moving blade ring arranged on the outer circumference of the rotor disc, a shroud plate ring arranged on the outer circumference of the rotor disc and at least one arrangement according to one of the above-stated configurations or any desired combination thereof. The advantages stated above with regard to the arrangement are accordingly associated with said assembly.

The rotor according to the invention for a gas turbine comprises at least one above-stated rotor assembly.

The gas turbine according to the invention comprises an above-mentioned rotor.

BRIEF DESCRIPTION OF THE DRAWINGS

An embodiment of the arrangement according to the invention is explained below with reference to the appended schematic drawings, in which.

DETAILED DESCRIPTION OF INVENTION

Figure 1:
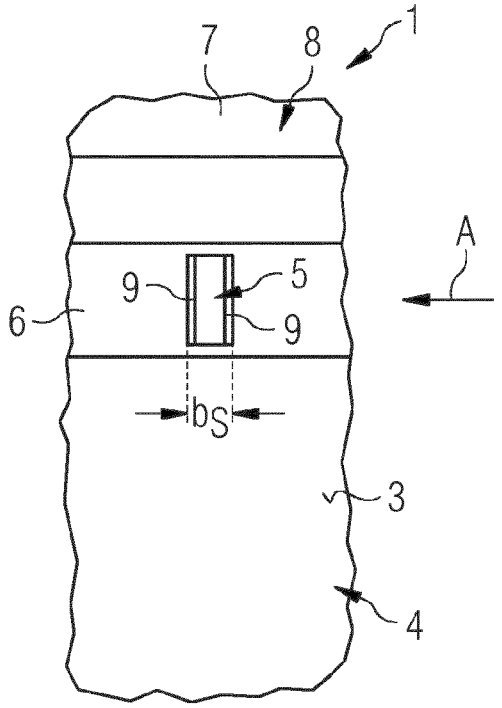
FIG. 1 shows a portion of a side view of an exemplary embodiment of a moving blade according to the invention.
Figure 7:
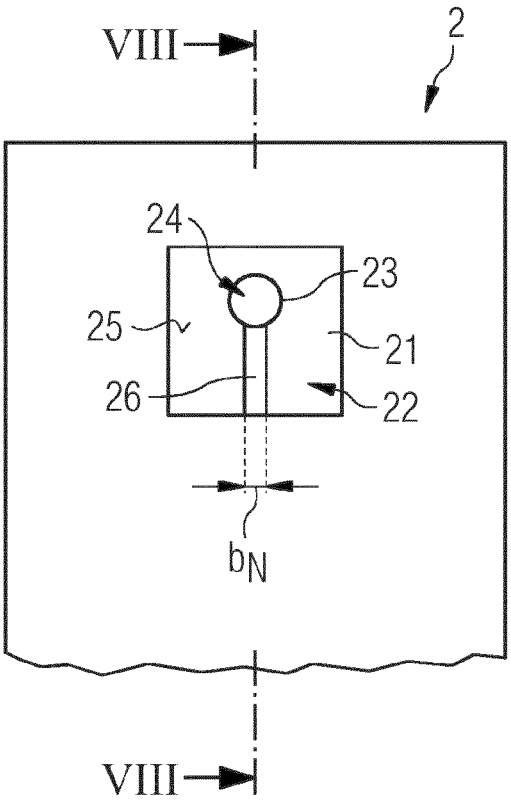
FIG. 7 shows a portion of a side view of an exemplary embodiment of a shroud plate according to the invention.
Figure 8:
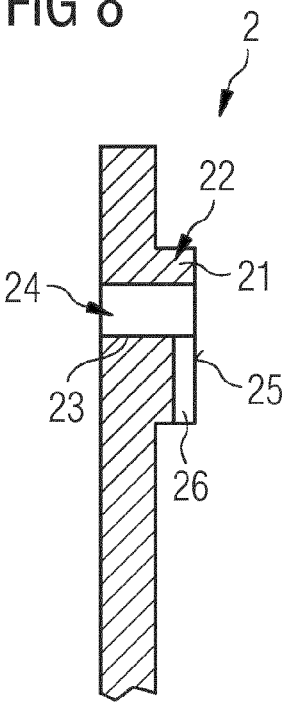
FIG. 8 shows a portion of a longitudinal section through the shroud plate shown in FIG. 7.
Figure 9:
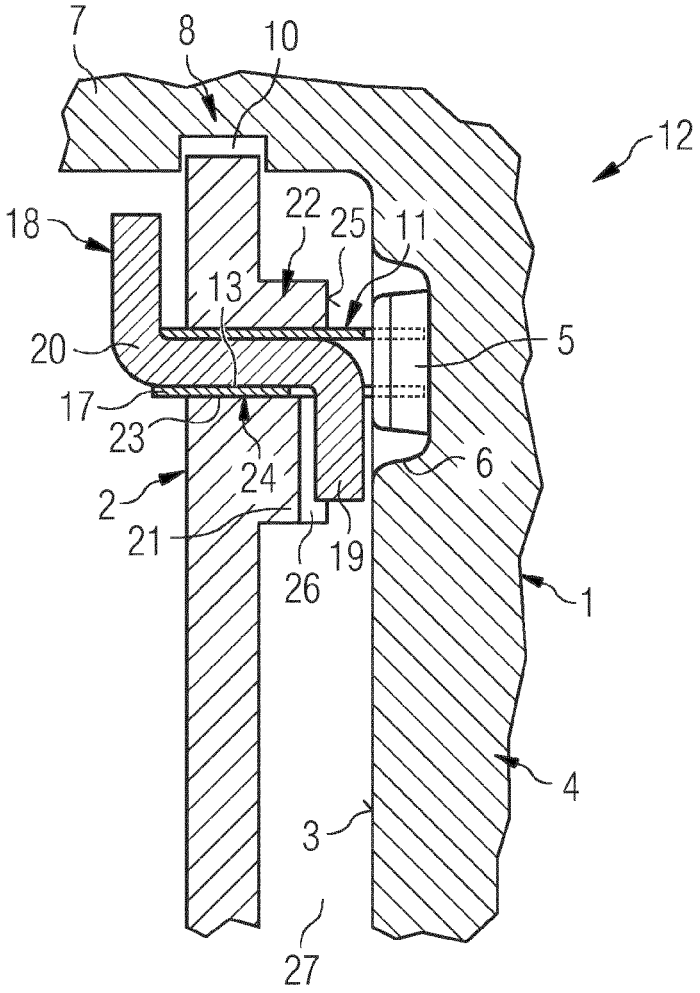
FIG. 9 shows a portion of a sectional representation of an exemplary embodiment of an arrangement according to the invention in its functional position.

FIG. 1 shows a portion of a side view of an exemplary embodiment of a moving blade 1 according to the invention, i.e. a moving blade 1 which comprises a web 5 arranged on the side 3, facing a shroud plate 2 shown in FIGS. 7, 8 and 9, of the blade root 4 of the moving blade 1, which web is arranged in such a way on the blade root 4 that the web 5 extends radially relative to the rotor disc when the moving blade 1 is arranged on a rotor disc, not shown. The web 5 is arranged in a recess 6 formed on the side 3 of the blade root 4 facing the shroud plate 2, a fact which is revealed better by FIGS. 2 and 9. The web 5 is formed in one piece with the moving blade 1, wherein the two longitudinal edges of the web 5 arranged on the side of the web 5 remote from the blade root 4 are each provided with a chamfer 9. A sealing wing 7 of a platform 8 of the moving blade 1 is arranged above the recess 6.

Figure 2:
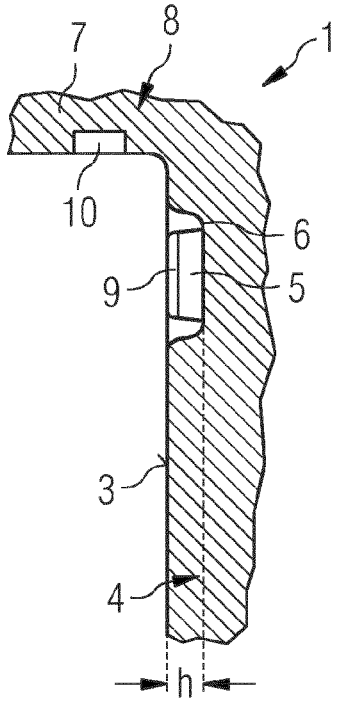
FIG. 2 shows a portion of a sectional representation of the moving blade shown in FIG. 1.

FIG. 2 shows a portion of a sectional representation of the moving blade 1 shown in FIG. 1 corresponding to the arrow A shown in FIG. 1. On the sealing wing 7 of the platform 8 of the moving blade 1, a sealing groove 10 is formed on the blade root side, in which sealing groove a radially outer edge portion of the shroud plate 2 may be arranged, as shown in FIG. 9. The web 5 terminates flush with the rest of the side 3, facing the shroud plate 2, of the blade root 4, i.e. the height h of the web 5 corresponds to the depth of the recess 6.

Figure 3:
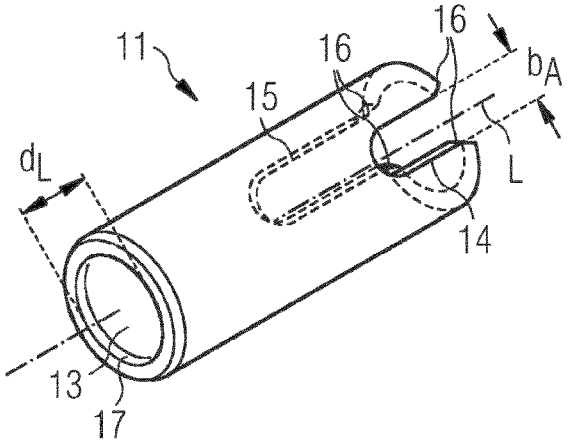
FIG. 3 is a perspective representation of an exemplary embodiment of a securing bolt of an arrangement according to the invention.

FIG. 3 shows a perspective representation of an exemplary embodiment of a securing bolt 11 of an arrangement 12 according to the invention, as shown in FIG. 9. The securing bolt 11 comprises a longitudinal through-hole 13 and at one end two cut-aways 14 and 15 arranged diametrically relative to one another, open towards said end and of equal width. The cut-aways 14 and 15 extend from said end of the securing bolt 11 parallel to the longitudinal axis L of the securing bolt 11 over part of the length of the securing bolt 11. The width $b_A$ of the cut-aways and the diameter $d_L$ of the longitudinal hole 13 are equal to the width $b_S$ of the web 5. The free ends of the cut-aways 14 and 15 are in each case provided with a chamfer 16. The end of the securing bolt 11 not provided with the cut-aways 14 and 15 is provided, on a side facing the longitudinal hole 13, with rounding 17 extending over the entire inner circumference of the longitudinal hole 13, which can be seen better from FIG. 4.

Figure 4:
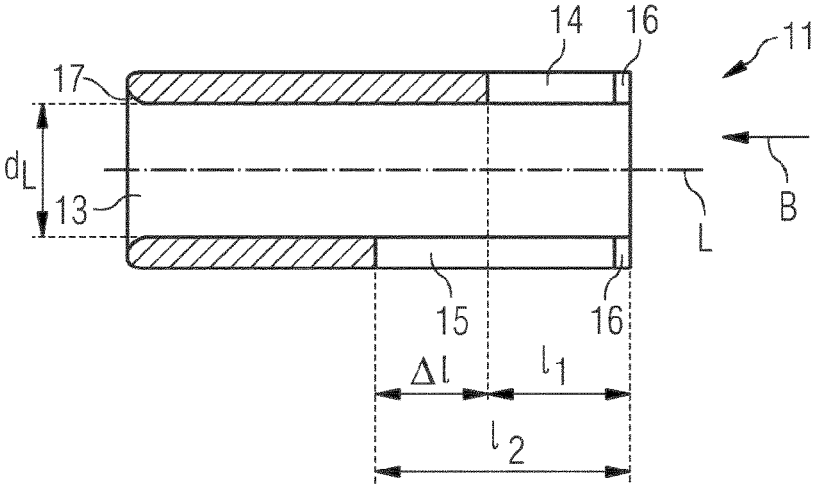
FIG. 4 shows a longitudinal section through the securing bolt shown in FIG. 3.

FIG. 4 shows a longitudinal section through the securing bolt 11 shown in FIG. 3. The cut-away 15 is longer than the cut-away 14 by a predetermined difference in length Δl=l2−l1. The length l1 of the shorter cut-away 14 is equal to the height h of the web 5. The difference in length Δl, the width bA of the cut-aways 14 and 15 and the width bS of the web 5 are equal to the diameter d of the longitudinal hole 13.

Figure 5:
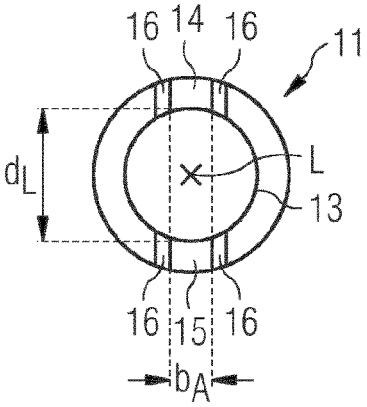
FIG. 5 is an end view of the securing bolt shown in FIG. 3.

FIG. 5 shows an end view of the securing bolt 11 shown in FIGS. 3 and 4 corresponding to arrow B of FIG. 4.

Figure 6:
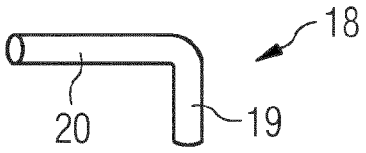
FIG. 6 is a side view of an exemplary embodiment of a securing wire of the arrangement according to the invention.

FIG. 6 shows a side view of an exemplary embodiment of a securing wire 18 of the arrangement 12 according to the invention. The plastically deformable securing wire 18 is of L-shaped construction and comprises one shorter leg 19 and one longer leg 20. The securing wire 18 has a circular cross-section and is formed of metal. The securing wire 18 forms part of a securing device for securing the functional position, shown in FIG. 9, of the securing bolt 11 on the shroud plate 2 and the moving blade 1. The length $l_2$ of the longer cut-away 15 is equal to the sum of the height h of the web 5 and the external diameter $d_a$ of the securing wire. The diameter $d_L$ of the longitudinal hole 13, the difference in length Δl, the width $b_A$ of the cut-aways 14 and 15 and the width $b_S$ of the web 5 are equal to the external diameter $d_a$ of the securing wire 18.

FIG. 7 shows a portion of a side view of an exemplary embodiment of a shroud plate 2 according to the invention. A guide portion 22 formed by a thickened portion 21 formed on the shroud plate 2 and a guide opening 24 formed by a through-hole 23 arranged in the shroud plate 2 are arranged on the shroud plate 2, wherein the guide portion 22 completely surrounds the guide opening 24. The securing device comprises a groove 26 arranged on the side 25 of the guide portion 22 facing the blade root 4, which groove extends from the guide opening 24 radially over the guide portion 22. The width $b_N$ of the groove 26 is equal to the external diameter $d_a$ of the securing wire 18. The external diameter $d_S$ of the securing bolt 11 is equal to the diameter $d_F$ of the guide opening 24.

FIG. 8 shows a portion of a longitudinal section through the shroud plate 2 shown in FIG. 7, corresponding to line VIII-VIII in FIG. 7.

FIG. 9 shows a portion of a sectional representation of an exemplary embodiment of an arrangement 12 according to the invention for securing the functional position shown of the shroud plate 2 of a rotor of a gas turbine, which shroud plate 2 is arranged on an outer circumference of a rotor disc of the rotor, relative to the moving blade 1 of the rotor arranged on the outer circumference of the rotor disc. A channel portion 27 of an annular cooling channel, not shown in any greater detail, of the rotor is formed between the shroud plate 2 located in its functional position and the side 3, facing the shroud plate 2, of a blade root 4 of the moving blade 1.

Assembly of the arrangement 12 shown in FIG. 9 is described below in greater detail:

First of all, the securing wire 18 may be pre-mounted in the securing bolt 11, by inserting the longer leg 20 of the securing wire 18 into the longitudinal hole 13 in the securing bolt 11 until the shorter leg 19 of the securing wire 18 engages in the longer cut-away 15 of the securing bolt 11. The assembly pre-assembled in this way may be pushed from the side 25, facing the blade root 4, of the guide portion 22 into the guide opening 24, until the shorter leg 19 of the securing wire 18 is arranged at least in part in the groove 26. In this way, the securing wire 18 is secured against axial rotation. Then the shroud plate 2 may be positioned, together with the assembly arranged thereon of securing wire 18 and securing bolt 11, in a functional position relative to the moving blade 1 or the blade root 4 thereof. The securing bolt 11 may then be pushed from the side of the shroud plate 2 remote from the blade root 4 axially towards the blade root 4 and displaced such that the web 5 engages in the cut-aways 14 and 15 on the securing bolt 11. Finally, the end of the longer leg 20 of the securing wire 18 projecting out of the securing bolt 11 may be bent radially outwards over the rounding 17 formed on the securing bolt 11, as shown in FIG. 5. This prevents the securing bolt 11 from being able to move axially away from the blade root 4.

Although the invention has been illustrated and described in greater detail with reference to the preferred exemplary embodiment, the invention is not restricted by the disclosed examples and other variations may be derived therefrom by a person skilled in the art without going beyond the scope of protection of the invention.

The invention claimed is:

1. An arrangement for securing a functional position of a shroud plate of a rotor of a gas turbine, which shroud plate is arranged on an outer circumference of a rotor disc of the rotor, relative to a moving blade of the rotor arranged on the outer circumference of the rotor disc, wherein a channel portion of an annular cooling channel of the rotor is formed between the shroud plate located in its functional position and a side, facing the shroud plate, of a blade root of the moving blade, the arrangement comprising:

a web which is arranged on the side of the blade root facing the shroud plate, which web is arranged in such a way on the blade root that the web extends radially relative to the rotor disc when the moving blade is arranged on the rotor disc, a guide portion, which is formed by a thickened portion formed on the shroud plate, and a guide opening, which is formed by a through-hole arranged on the shroud plate, wherein the guide portion at least partially surrounds the guide opening, a securing bolt, adapted to pass through the guide opening, the securing bolt comprising a longitudinal through-hole, the external diameter of which corresponds to the diameter of the guide opening and which comprises at one end two cut-aways arranged diametrically relative to one another, open towards said end and of equal width, which cut-aways extend from said end of the securing bolt parallel to the longitudinal axis of the securing bolt over part of the length of the securing bolt, wherein the width of the cut-aways is greater than or equal to the width of the web, wherein the two cut-aways are adapted to be engaged by the web, wherein in an assembled state, the securing bolt passes through the guide opening and the cutaways engage the web, and a securing device for securing a functional position of the securing bolt on the shroud plate and the moving blade.

2. The arrangement as claimed in claim 1, wherein the securing device comprises a groove which is arranged on the side of the guide portion facing the blade root, which groove extends from the guide opening radially over at least part of the guide portion, and an L-shaped, plastically deformable securing wire, adapted to pass through the longitudinal through-hole of the securing bolt and into the groove, wherein the internal diameter of the longitudinal hole and the width of the groove are greater than or equal to the external diameter of the securing wire.

3. The arrangement as claimed in claim 2, wherein one cut-away is longer than the other cut-away by a predetermined difference in length, wherein the difference in length is greater than or equal to the external diameter of the securing wire.

4. The arrangement as claimed in claim 1, wherein the web is formed in one piece with the moving blade.

5. The arrangement as claimed in claim 1, wherein the web is arranged in a recess formed on the side of the blade root facing the shroud plate.

6. The arrangement as claimed in claim 1, wherein at least one longitudinal edge of the web arranged on the side of the web remote from the blade root is provided with a chamfer.

7. The arrangement as claimed in claim 1, wherein the end of the securing bolt not provided with the cut-aways is provided, on a side facing the longitudinal hole, with rounding extending over at least part of the entire inner circumference of the longitudinal hole.

8. The arrangement as claimed in claim 1, wherein at least one free end of at least one cut-away is provided with a chamfer.

9. The arrangement as claimed in claim 1, further comprising a sealing groove which is arranged on a sealing wing formed on a platform of the moving blade, in which sealing groove a radially outer edge portion of the shroud plate is arranged.

10. A rotor assembly for a rotor of a gas turbine, comprising a rotor disc, a moving blade ring arranged on the outer circumference of the rotor disc, a shroud plate ring arranged on the outer circumference of the rotor disc and at least one arrangement as claimed in claim 1.

11. A rotor for a gas turbine, comprising at least one rotor assembly as claimed in claim 10.

12. A gas turbine, comprising at least one rotor as claimed in claim 11.

13. An arrangement for securing a functional position of a shroud plate of a rotor of a gas turbine, which shroud plate is arranged on an outer circumference of a rotor disc of the rotor, relative to a moving blade of the rotor arranged on the outer circumference of the rotor disc, wherein a channel portion of an annular cooling channel of the rotor is formed between the shroud plate located in its functional position and a side, facing the shroud plate, of a blade root of the moving blade, the arrangement comprising:

a web which is arranged on the side of the blade root facing the shroud plate, which web is arranged in such a way on the blade root that the web extends radially relative to the rotor disc when the moving blade is arranged on the rotor disc, a guide portion, which is formed by a thickened portion formed on the shroud plate, and a guide opening, which is formed by a through-hole arranged on the shroud plate, wherein the guide portion at least partially surrounds the guide opening, a securing bolt, adapted to pass through the guide opening, the securing bolt, the securing bolt comprising a longitudinal through-hole, the external diameter of which corresponds to the diameter of the guide opening and which comprises at one end two cut-aways arranged diametrically relative to one another, open towards said end and of equal width, which cut-aways extend from said end of the securing bolt parallel to the longitudinal axis of the securing bolt over part of the length of the securing bolt, wherein the width of the cut-aways is greater than or equal to the width of the web, wherein the two cut-aways are adapted to be engaged by the web, wherein in an assembled state, the securing bolt passes through the guide opening and the cutaways engage the web, and a groove which is arranged on the side of the guide portion facing the blade root, which groove extends from the guide opening radially over at least part of the guide portion, and an L-shaped, plastically deformable securing wire, adapted to pass through the longitudinal through-hole of the securing bolt and into the groove.

14. The arrangement as claimed in claim 13, wherein the internal diameter of the longitudinal hole and the width of the groove are greater than or equal to the external diameter of the securing wire.

15. A rotor assembly for a rotor of a gas turbine, comprising a rotor disc, a moving blade ring arranged on the outer circumference of the rotor disc, a shroud plate ring arranged on the outer circumference of the rotor disc and at least one arrangement as claimed in claim 13.

* * * * *